US006467722B1

(12) United States Patent
Berry et al.

(10) Patent No.: US 6,467,722 B1
(45) Date of Patent: Oct. 22, 2002

(54) MAGNETOSTRICTIVE MISSILE GUIDANCE SYSTEM

(75) Inventors: Roger P. Berry, Huntsville, AL (US); Daniel F. Lawless, Hazel Green, AL (US); Stephen C. Cayson, Huntsville, AL (US); Lamar M. Auman, Union Grove, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/059,111

(22) Filed: Jan. 31, 2002

(51) Int. Cl.[7] ..... F41G 7/00; F42B 15/01
(52) U.S. Cl. ..... 244/3.21; 244/3.1
(58) Field of Search ..... 244/3.1, 3.11, 244/3.12–3.19, 3.2, 3.21, 3.22–3.29, 3.3, 2, 3, 158 R, 164–171, 117 R, 119, 120; 114/20.1, 23

(56) References Cited

U.S. PATENT DOCUMENTS

| | | | | | |
|---|---|---|---|---|---|
| 2,594,766 | A | * | 4/1952 | Goddard | 244/3.1 |
| 3,262,655 | A | * | 7/1966 | Gillespie, Jr. | 244/3.1 |
| 3,955,046 | A | * | 5/1976 | Ingham et al. | 244/3.17 |
| 3,977,629 | A | * | 8/1976 | Tubeuf | 244/3.22 |
| 4,399,962 | A | * | 8/1983 | Wedertz et al. | 244/3.23 |
| 4,431,147 | A | * | 2/1984 | Paley | 244/3.3 |
| 4,579,298 | A | * | 4/1986 | Thomson | 244/3.1 |
| 4,793,571 | A | * | 12/1988 | Kranz | 244/3.1 |
| 5,139,216 | A | * | 8/1992 | Larkin | 244/3.1 |
| 5,322,248 | A | * | 6/1994 | Ragab | 244/3.15 |
| 5,593,109 | A | * | 1/1997 | Williams | 244/3.21 |
| 5,708,232 | A | * | 1/1998 | Nedderman, Jr. | 244/3.1 |
| 6,364,248 | B1 | * | 4/2002 | Spate et al. | 244/3.21 |

OTHER PUBLICATIONS

TESS listing for the Trademark "ETREMA TERFENOL–D"; Ser. No. 73703116, Registration No. 1512330.*

TESS listing for the Trademark "ETREMA"; Ser. No. 73689817, Registration No. 1507785.*

* cited by examiner

*Primary Examiner*—Bernarr E. Gregory
(74) *Attorney, Agent, or Firm*—Arthur H. Tischer; Freddie M. Bush; Hay Kyung Chang

(57) ABSTRACT

The Magnetostrictive Missile Guidance System pivots the missile nosecone about a multi-directional joint on the missile axis to produce aerodynamic control forces for missile flight path control. The nosecone is driven by magnetostrictive materials in conjunction with displacement amplification devices. The determination of the nosecone deflection angle necessary to achieve any change in the flight path is made by a sensing device that produces position signals and a guidance computer that produces the desired flight path command signals. The sensing device senses the current position of the nosecone and this position signal is compared with the command signal by the computer to yield an error signal, which is indicative of the difference between the two input signals. Then appropriate magnetic field is applied to the magnetostrictive materials to cause them to grow in length and deflect the nosecone until the error signal is eliminated and flight path is changed.

21 Claims, 6 Drawing Sheets

SECTION I-I (4 Actuators)

SECTION I-I (3 Actuators)

MAGNETOSTRICTIVE MISSILE GUIDANCE SYSTEM

The invention described herein may be manufactured, used and licensed by or for the Government for governmental purposes without the payment to us of any royalties thereon.

BACKGROUND OF THE INVENTION

Historically, missile flight direction control has been achieved by using thrust vector control (TVC), jet reaction control (JRC), canard control or tail fin control. However, each of these control methods has significant disadvantages. For example, even though TVC systems provide high controllability with minimal drag force, they are only effective during the boost portion of the flight. JRC systems can provide control during the entire flight and also have very low drag, but are limited by the amount of propellant that can be packaged in the missile. Canard and tail fin controls enable excellent controllability provided that the missile velocity is sufficient. The disadvantage is that canard and tail fin control systems can result in excessive drag.

Currently, there no known missiles that utilize deflection of the missile nosecone for controlling their flight paths.

SUMMARY OF THE INVENTION

The Magnetostrictive Missile Guidance System (MMGS) uses a movable nosecone that pivots about a single multi-directional joint on the missile axis in order to produce aerodynamic control forces for missile flight path control. The missile nosecone is driven by magnetostrictive materials in conjunction with a displacement amplification device. The determination of the nosecone deflection angle that is necessary to achieve any change in the flight path is made by a sensing device that produces position signals and a guidance computer that produces command signals for the desired flight path. The sensing device located in the nosecone senses the current position of the nosecone and this position signal is compared with the command signal by the computer to yield an error signal, which is indicative of the difference between the two input signals. Then appropriate magnetic field is applied to the magnetostrictive materials to cause them to grow in length and deflect the nosecone until the error signal is eliminated.

The significant control authority enabled by MMGS is available during both boost and coast, all without the disadvantage of excessive drag.

DESCRIPTION OF THE PREFERRED EMBODIMENT

Figure 1:
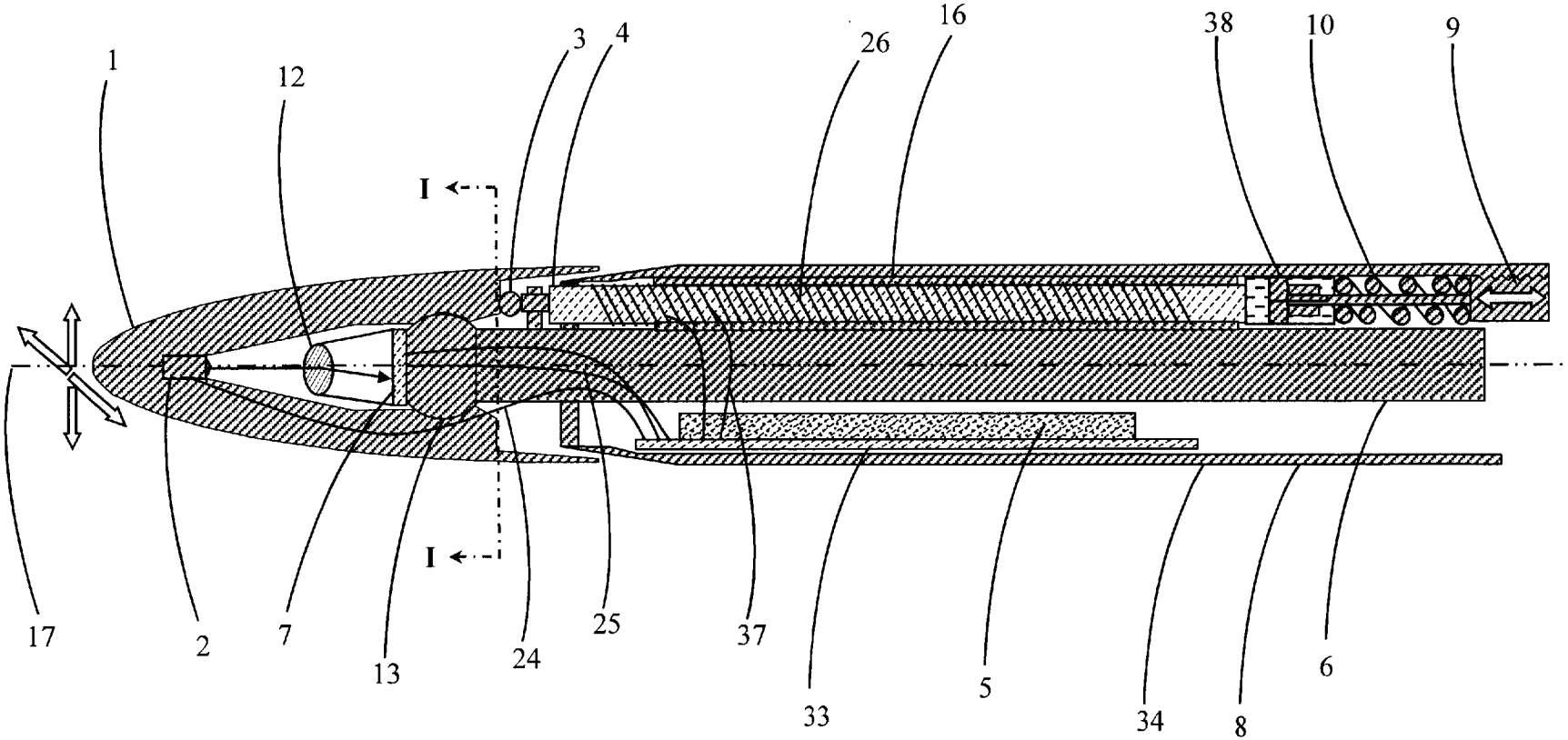
FIG. 1 shows a cross-sectional view of the entire length of the missile containing the MMGS.
Figure 2:
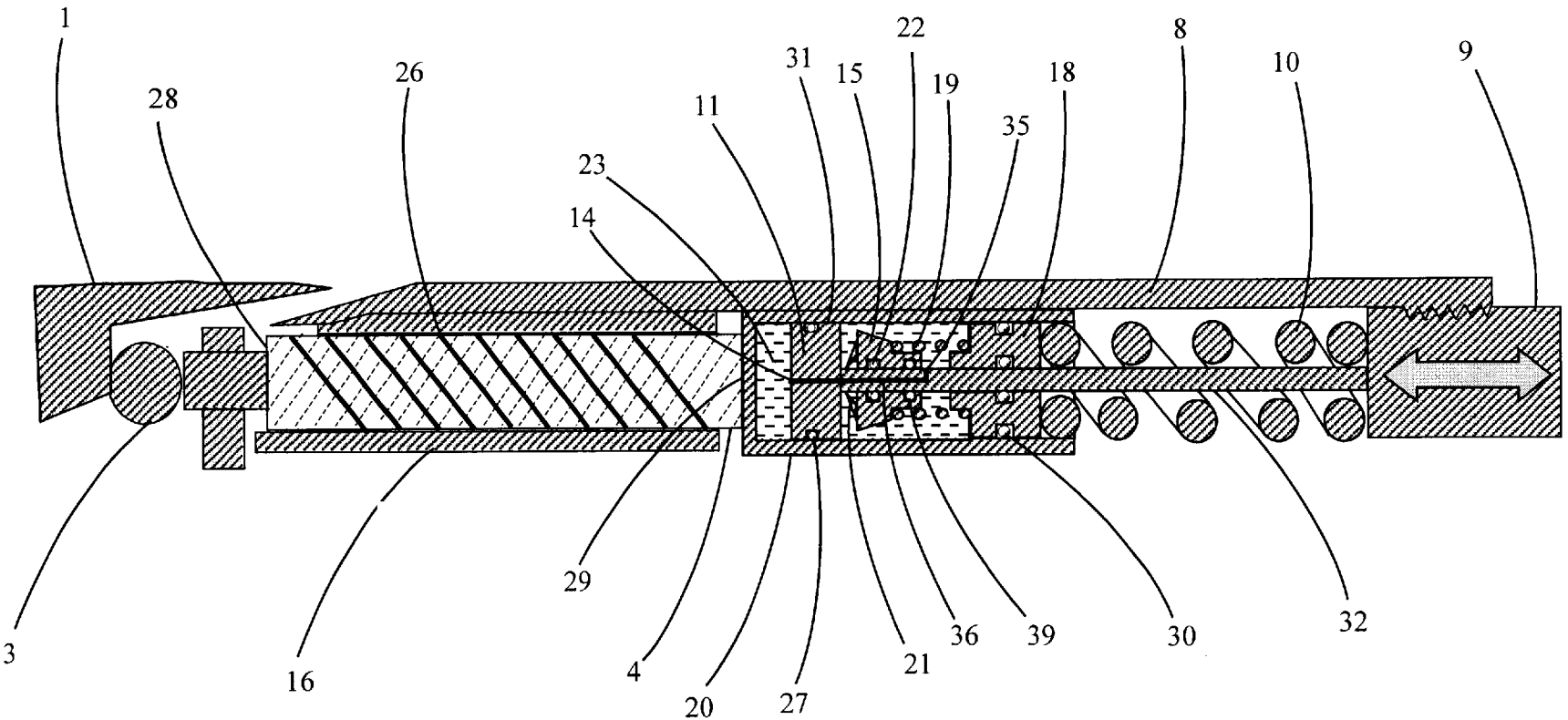
FIG. 2 is a detailed depiction of a representative amplifier and actuator including the magnetostrictive rod.
Figure 4:
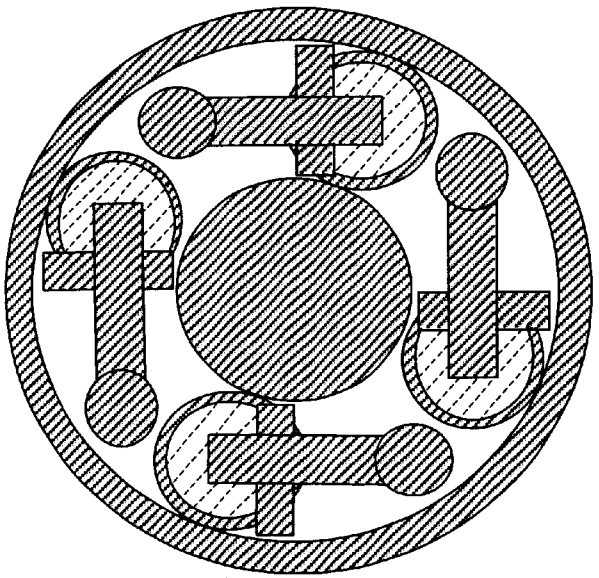
FIG. 4 shows how three or four actuators are positioned inside the missile.
Figure 4:
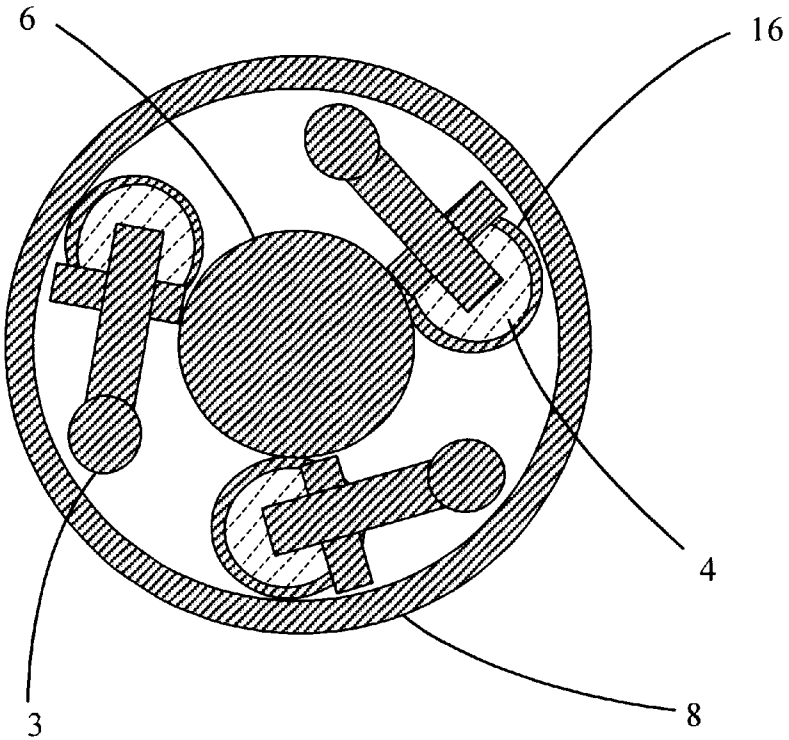

Referring now to the drawing wherein like numbers represent like parts in each of the several figures, FIG. 1 gives an overall cross-sectional view of the MMGS usefully positioned inside a typical kinetic energy missile 34. It is noted that even though FIGS. 1 and 2 show only one actuator comprised of a magnetostrictive rod and its attendant accessories, the figures are representative. The missile contains at least three such actuators, all identical to each other in structure and function and disposed at equal-degree intervals around missile axis 17. FIG. 4 shows how three (disposed at 120-degree intervals) or four (disposed at 90-degree intervals) actuators can be utilized in one missile. Therefore, the following description of the structure and function of an actuator applies equally to all of the multiple, identical actuators that may be employed in the missile.

During storage and handling prior to launch, it is important that magnetostrictive rod 4 not slosh loosely inside the missile but remain securely in place with no empty linear spaces between it and other components such as amplifier 3 and adjustment platform 9. This maintenance of direct contact is accomplished by dashpot assembly 38 and first spring 10 which are presented in greater detail in FIG. 2. During manufacture of the missile, adjustment platform 9 is adjusted to move first spring 10 into direct contact with dashpot assembly 38 which, in turn, moves into direct contact with second end 29 of magnetostrictive rod 4. This causes first end 28 of the rod to come into contact with motion amplifier 3 and ultimately with movable nosecone 1. After tolerances for the passive stage of the missile have been adjusted thusly, platform 9 is fixedly mounted onto interior surface of missile body 8 and no longer allowed to move linearly along missile axis 17.

Now, the maintenance of the direct contact between the various components of the actuator is highly critical due to the small movements of the energized actuator and the minimal backlash requirement for missile guidance control. Since missile environments expose the actuator to large temperature changes, dashpot assembly 38 has been devised to absorb the changes in overall system stack height caused by the thermal expansion and contraction of the actuator components. Such extension or contraction is accommodated by the use of dashpot assembly 38 filled with hydraulic fluid and positioned between rod 4 and first spring 10. More specifically, inside dashpot housing 20, sealing collar 15, dashpot piston 31 and first pressure vent 14 are structured and positioned relative to each other so as to enable them to cooperate. The goal of the cooperation is to compel first spring 10 to maintain a constant force on the overall actuator through pressurizer 18 and the hydraulic fluid so that they take up the differentials in magnetostrictive rod length due to thermal expansion and contraction. Second O-ring 30 around the pressurizer seals the total volume of the hydraulic fluid up to the moment of launch. The first and second springs, pressurizer and the sealing collar are all mounted to surround arm 32.

At the moment of missile launch, the tremendous acceleration forces thrust sealing collar 15 toward pressurizer 18 and cause third and fourth O-rings 22 and 39 of the sealing collar to move along arm 32 to a position where they sandwich second pressure vent 35 between them. This sandwiching action effectively seals the second pressure vent and solidifies the length of the assembly due to the hydraulic fluid captured within chamber 23. First O-ring 27 seals the base in place to form the chamber in conjunction with dashpot housing 20. First pressure vent 14 located at the base and communicating with second pressure vent 35 via channel 36, must be small because the thermal change during storage is small and upon launch, the fluid loss out of the chamber must be small. For the duration of the flight, the sealing collar is held in place against the pressurizer by pinching fingers 21. Second spring 19 is useful during storage and handling of the missile to keep the sealing collar disengaged until the moment of launch.

Figure 3:
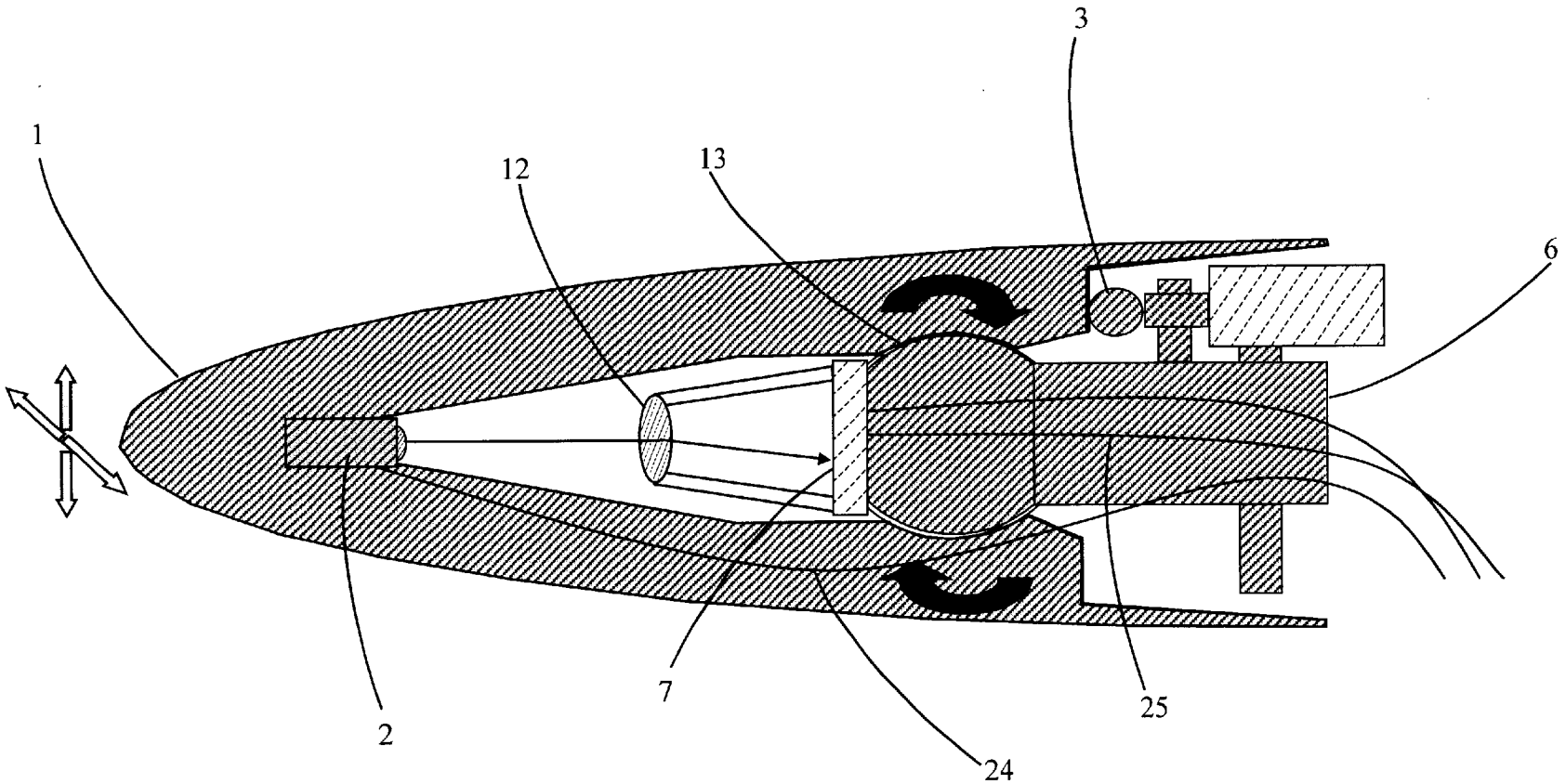
FIG. 3 details the sensing device and the multi-directional joint.
Figure 6:
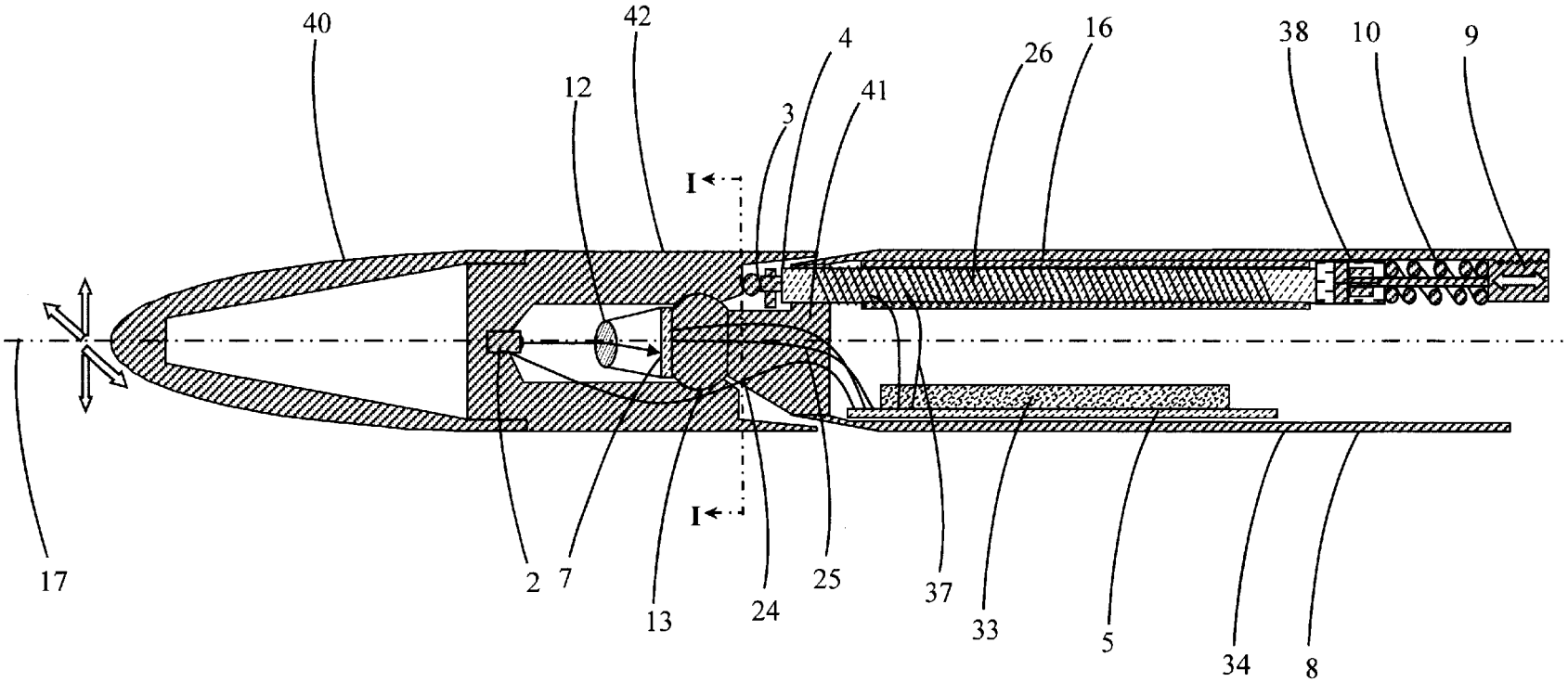
FIG. 6 illustrates a possible location of the multi-directional joint in a non-hypervelocity missile.

At any time during the flight, laser 2, mounted along the axis inside nosecone 1 near the tip and powered by power source 33 via first wire 24, transmits light onto lens 12 whereby the light is refracted and is incident on light detector 7. This is illustrated in FIG. 3. The detected light signal indicative of the current position of the nosecone is input to computer 5, which also generates the desired nosecone command signal. The computer compares the position signal with the command signal and produces an error signal based on the difference between the two input signals. The error signal is then used by the computer to generate a voltage command that motivates power source 33 to apply current, via second wire 37, to coil 26 surrounding magnetostrictive rod 4. The current in the coil creates a magnetic field around the rod, causing the rod to grow in length. The growth is translated into motion and amplified by amplifier 3, which, in turn, deflects the nosecone by rotating it around multi-directional joint 13 until the error signal is eliminated. The multiple rods (each in an actuator) included in the MMGS can grow by different amounts under command of the computer and jointly achieve deflection of the nosecone to turn the missile to fly in any desired direction. In FIGS. 1 and 3, the multi-directional joint is shown as mounted along the missile axis at the end of penetrator 6. However, in non-hypervelocity missiles which have no penetrators, this joint can be mounted anywhere along the missile axis and the rigid mounting requirements can be met by mounting the joint securely to missile frame 41. The joint, wherever located, divides the missile into movable first part 40 that deflects by rotating around the joint and second part 42 whose orientation relative to the joint is fixed. An example of this is illustrated in FIG. 6.

The rotation of nosecone 1 about joint 13 results in non-symmetric airflow over the missile, which produces an imbalance in the aerodynamic force and moment on the missile. This imbalance in aerodynamic force and moment is utilized to change the flight path of the missile. The missile rotates about its center-of-gravity until the moment imbalance is nullified.

For the MMGS to function optimally, magnetostrictive rod 4 should have an unmagnetized length that is sufficient to provide usable changes in length when a magnetic field is applied. What is sufficient length depends on factors such as the type of the missile in which the rod is to be used and the maneuvers required to reach the target (example: small turns as opposed to large turns). An acceptable material for the rod is ETREMA Terfenol-D® A trademark for Magnetostrictive Alloys, available from ETREMA Products, Inc. The typical change in rod length when a magnetic field is applied is 0.001 inch per inch of the rod. A magnetostrictive rod of 30 inches in length combined with a 3:1 amplification provides a 5° nosecone deflection angle. Aerodynamic estimates indicate that a 5° nosecone deflection will generate control forces acting on the missile body in the order of 200 lbf. The level of output force that is available from the rod itself is determined by the diameter of the magnetostrictive rod and determines how well the nosecone can be aerodynamically balanced. Typically, a rod diameter of 0.5 inches will provide an output force of 200 lbf. So, if 3:1 amplification is used, the force available for actuation is reduced to approximately 60 lbf. Since the output force of the magnetostrictive rod is large, anti-buckle sleeve 16 can be used to support the rod in view of the large compressive loads and a large length-to-diameter ratio.

The long length of the rod overcomes the potential limitation of using magnetostrictive material whose travel is small (0.1 to 0.2% of material length). The long length, combined with the amplifier, provides a deflection of the nosecone that is sufficient to control the flight path of a missile.

Figure 5:
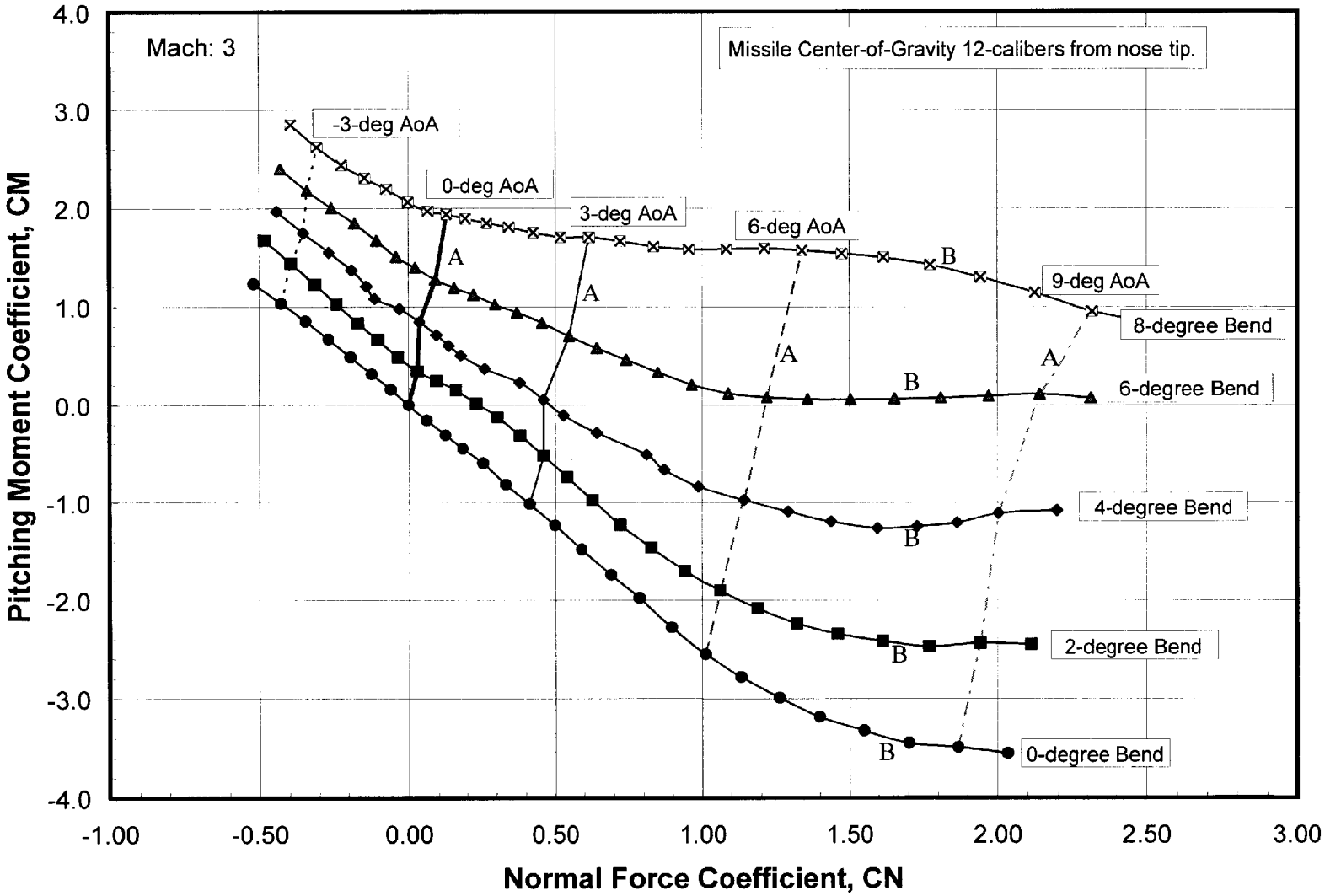
FIG. 5 is a typical stability map for a missile utilizing MMGS.

FIG. 5 is a stability map showing lines of constant Angle-of-Attack (A) and lines of constraint bent nose deflection (B). As is shown in this figure, nose deflections ranging from 0° to 5° will produce trim normal force coefficients, which range from 0 to 0.7. The angular displacement of the nosecone and resulting aerodynamic force is primarily effective in one direction lateral to the missile centerline. Since multi-directional joint 13 can be manipulated in any desired direction, the missile flight path can be altered in any direction relative to the missile motion.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A system for guiding the flight of a missile in any given direction, the missile having a movable nosecone and an elongated body with an axis, by deflecting the nosecone by a pre-determined angle, said guiding system residing within said missile and comprising: a plurality of variable-length actuators; a means for generating a desired nosecone command signal; a means for varying the lengths of said actuators by pre-selected amounts, said varying means being further coupled to said generating means; a means for sensing the current position of said nosecone and, in response thereto, producing a corresponding position signal, said sensing means being coupled to said generating means, said generating means further receiving said position signal from said sensing means and processing said position signal with said nosecone command signal to produce an error signal, said error signal serving to motivate said generating means to determine the angle of nosecone deflection necessary to nullify said error signal, said varying means then responding to said deflection angle to cause the growth in the length of at least one of said actuators by a pre-selected amount; and a plurality of motion amplifiers, said amplifiers being coupled between said nosecone and said actuators, such that there is one of said amplifiers between one of said actuators and said nosecone, said amplifiers translating said growth in length of said actuators into motion and amplifying and transmitting said motion to said nosecone, thereby causing said nosecone to deflect in response to said motion until said pre-determined angle of deflection is achieved and a desired change in the direction of the missile flight is ultimately effected.

2. A system for guiding the flight of a missile in any given direction as set forth in claim 1, wherein said plurality of actuators are identical in structure and function and each comprises: a magnetostrictive rod having a pre-determined unmagnetized length and a diameter, said rod further having a first end and a second end and being aligned parallel with the axis of said missile within said body of said missile, wherein said first end is in contact with said motion amplifier; and a means for maintaining said rod rigidly in place within said body of said missile until launch of said missile.

3. A system for guiding the flight of a missile in any given direction as set forth in claim 2, wherein said unmagnetized length is sufficient to provide usable changes in length when said rod is magnetized.

4. A system for guiding the flight of a missile in any given direction as set forth in claim 3, wherein said plurality of motion amplifiers are identical in structure and function.

5. A system for guiding the flight of a missile in any given direction as set forth in claim 4, wherein said maintaining means comprises: an adjustment platform mounted fixedly onto the interior surface of the missile; a dashpot assembly; and a first spring, said first spring being coupled between said platform and said dashpot assembly to afford flexible spacing between said platform and said dashpot assembly, wherein said dashpot assembly is securely lodged between said second end of said magnetostrictive rod and said first spring.

6. A system for guiding the flight of a missile in any given direction as set forth in claim 5, wherein said dashpot assembly comprises: a housing containing therein compressible hydraulic fluid; a piston residing within said housing, said piston being comprised of a base and an arm extruding from said base, said base having a first O-ring therearound for rendering a complete seal between said base and said housing upon launch of the missile; a pressurizer having a second O-ring therearound to accommodate the expansion and contraction of said hydraulic fluid prior to the launch of the missile, said pressurizer being positioned to be in contact with said first spring while being mounted to surround said arm; a sealing collar mounted on said arm to surround said arm and to be located between said base and said pressurizer; and a second spring coupled between said collar and said pressurizer.

7. A system for guiding the flight of a missile in any given direction as set forth in claim 6, wherein said piston has a first vent located on said base and a second vent located on said arm and a channel connecting said vents, said channel running through said piston.

8. A system for guiding the flight of a missile as set forth in claim 7, wherein said sealing collar, second spring and pressurizer are contained within said housing.

9. A system for guiding the flight of a missile as set forth in claim 8, wherein said sealing collar comprises a means for closing said second vent upon launch of the missile.

10. A system for guiding the flight of a missile as set forth in claim 9, wherein said dashpot assembly further comprises at least two pinching fingers, said fingers protruding from said sealing collar and, in cooperation with said second spring, preventing movement of said sealing collar after the closure of said second vent.

11. A system for guiding the flight of a missile as set forth in claim 10, wherein said dashpot assembly still further comprises a chamber formed by cooperation between said base and said housing, said chamber being suitable for holding therein a portion of said compressible hydraulic fluid.

12. A system for guiding the flight of a missile as set forth in claim 11, wherein said guiding system further comprises a plurality of identical anti-buckle sleeves, each of said sleeves supporting one of said actuators.

13. A system for guiding the flight of a missile as set forth in claim 12, wherein said generating means is a guidance computer for generating predetermined nosecone commands.

14. A system for guiding the flight of a missile as set forth in claim 13 wherein guiding system still further comprises a power source.

15. A system for guiding the flight of a missile as set forth in claim 14, wherein said position-sensing means resides within said movable nosecone and comprises: a laser, said laser being disposed along said axis of the missile near the tip of said nosecone; a first wire connecting said laser and said power source; a detector for detecting light impinging thereon, said detector deriving position signal from said detected light, said position signal being indicative of the current position of said nosecone; a refractive lens positioned between said laser and said detector for receiving light emanating from said laser and transmitting said light to impinge on said detector; and a means for coupling said detector to said generating means for forwarding said position signal to said generating means, thereby enabling said generating means to process said position signal with said nosecone command signal and produce any error signal as a result of said processing.

16. A system for guiding the flight of a missile as set forth in claim 15, wherein said guiding system still further comprises a multi-directional joint, said joint being positioned along said axis and coupling said movable nosecone with said body so as to allow said nosecone to be deflected in any given direction.

17. A system for guiding the flight of a missile as set forth in claim 16, wherein said means for varying the lengths of said actuators by pre-selected amounts comprises: a means for creating a magnetic field around said magnetostrictive rod, said creating means being coupled to said power source and to said generating means, said creating means responding to said error signal, so as to induce a growth of a pre-selected amount in the length of said rod and effect the deflection of said nosecone by said pre-determined angle.

18. A system for guiding the flight of a missile as set forth in claim 17, wherein said identical actuators are three in number, said three actuators being disposed at 120-degree intervals around said axis of the missile.

19. A system for guiding the flight of a missile as set forth in claim 17, wherein said identical actuators are four in number, said four actuators being disposed at 90-degree intervals around said axis of the missile.

20. For a missile having a movable first part and an elongated second part with an axis, a guidance system for guiding the flight of such a missile by deflecting said first part by a pre-determined angle so as to direct the missile to fly in any given direction, said guidance system comprising: a multi-directional joint, said joint coupling said movable first part with said second part so as to allow said first part to be deflected in any given direction; a plurality of variable-length magnetostrictive rods residing in said second part, each rod being parallel to said axis and having a predetermined unmagnetized length sufficient to provide usable changes in length when said rod is magnetized; a means for sensing the current position of said first part and, in response thereto, producing a corresponding position signal; a power source; a computer for generating a desired command signal for said first part, said computer being coupled to receive said position signal from said sensing means and, in response thereto, yielding error signal, said computer further being coupled to control said power source; a coil surrounding each of said rods, said coils being coupled to said computer and to said power source, said coils cooperating with said computer and said power source to apply electric current to said magnetostrictive rods to induce growths in the lengths of said magnetostrictive rods by pre-selected amounts; a plurality of motion amplifiers, said amplifiers being coupled between said first part and said magnetostrictive rods, such that there is one of said amplifiers between one of said rods and said first part, said amplifiers translating said growth in length of said rods into motion and amplifying and transmitting said motion to said first part, thereby causing said first part to deflect in response to said motion until said error signal is nullified and a desired change in the direction of the missile flight is ultimately achieved.

21. A guidance system for guiding the flight of a missile by deflecting said first part as described in claim 20, wherein each of said magnetostrictive rods is supported by a support base, said support base comprising: an adjustment platform mounted fixedly onto the interior surface of the missile; a dashpot assembly holding therein compressible hydraulic fluid; and a first spring, said first spring being coupled between said platform and said dashpot assembly to afford flexible spacing between said platform and said dashpot assembly, wherein said dashpot assembly is securely lodged between said first spring and said magnetostrictive rod and functioning to absorb a fraction of the growth in length of said rod while enabling most of the growth to be used by said motion amplifier to effect deflection of said first part.

* * * * *